US006772458B2

(12) United States Patent
Ellen et al.

(10) Patent No.: US 6,772,458 B2
(45) Date of Patent: Aug. 10, 2004

(54) COLLAPSIBLE RESTRAINING ENCLOSURE FOR A BED

(75) Inventors: Thomas D. Ellen, North Granby, CT (US); John J. Gildea, Bondville, VT (US)

(73) Assignee: Vivax Medical Corporation, Torrington, CT (US)

( * ) Notice: Subject to any disclaimer, the term of this patent is extended or adjusted under 35 U.S.C. 154(b) by 69 days.

(21) Appl. No.: 10/294,313

(22) Filed: Nov. 14, 2002

(65) Prior Publication Data

US 2003/0116566 A1 Jun. 26, 2003

Related U.S. Application Data

(60) Provisional application No. 60/332,750, filed on Nov. 14, 2001.

(51) Int. Cl.[7] ..... A47C 21/08

(52) U.S. Cl. ..... 5/424; 5/97; 5/98.1; 5/508; 5/414; 135/96; 135/143; 135/151

(58) Field of Search ..... 5/414, 508, 97, 5/98.1, 424; 135/96, 157, 143, 151

(56) References Cited

U.S. PATENT DOCUMENTS

| | | | | | |
|---|---|---|---|---|---|
| 875,206 | A | * | 12/1907 | Osborne | 135/96 |
| 1,410,830 | A | | 3/1922 | O'Neal | |
| 1,526,038 | A | | 2/1925 | Allman | |
| 2,850,027 | A | | 9/1958 | Smith | |
| 4,641,387 | A | * | 2/1987 | Bondy et al. | 5/508 |
| 5,384,925 | A | * | 1/1995 | Vail | 5/424 |
| 5,771,651 | A | | 6/1998 | Shiina | |
| 6,125,483 | A | | 10/2000 | Stroud et al. | |
| 6,216,291 | B1 | | 4/2001 | Eads et al. | |
| 6,263,529 | B1 | | 7/2001 | Chadwick et al. | |

* cited by examiner

*Primary Examiner*—Alexander Grosz
(74) *Attorney, Agent, or Firm*—McCarter & English, LLP

(57) ABSTRACT

A collapsible enclosure for restraining a patient to an area about a bed comprises a frame having a horizontal eave portion, a horizontal base portion opposing the horizontal eave portion, and at least two vertical members upstanding from the horizontal base portion for supporting the horizontal eave portion. The frame collapses as an integral unit for storage and transfer. A net assembly secured to the frame defines an area about a bed such that a patient is allowed to move freely within the area.

51 Claims, 15 Drawing Sheets

COLLAPSIBLE RESTRAINING ENCLOSURE FOR A BED

CROSS-REFERENCE TO RELATED APPLICATION

This application claims priority to U.S. Provisional Patent Application No. 60/332,750, filed Nov. 14, 2001, which is incorporated herein by reference.

BACKGROUND OF THE INVENTION

1. Field of the Invention

The subject invention relates to systems for providing a restraining enclosure for patients for whom it is desirable to restrain to a bed area.

2. Background of the Related Art

Various illnesses and conditions such as brain trauma, dementia and Alzheimer's disease often leave people in such a condition that constant management of the patient is necessary to prevent further injury and mishap. Traditional systems and methods for monitoring and controlling patients with such needs have included bed straps or restraints, straight jackets, sedation, a monitoring device, a dedicated individual at hand, isolation rooms and the like both alone and in combination. Many of these prior art methods and systems are burdensome to all concerned and prohibitively expensive. For example, bed straps immobilize a patient on a bed. When the patient desires to move or change position, the restraints prevent such shifting. As a result, a restrained patient can become very uncomfortable and/or agitated in addition to suffering medical complications. For another example, a dedicated person to attend to the restrained person's needs on an all day, every day basis is cost prohibitive.

Recently, several techniques for addressing confining a patient to a bed area while allowing free movement have been developed to address the needs of the patient and caregiver. Some examples are illustrated in U.S. Pat. Nos. 5,216,291 to Eads et al. and 6,263,529 to Chadwick et al., each of which is incorporated herein by reference. However, there are problems associated with the prior art enclosure bed apparatus. Often, the condition which requires restraint may be temporary and as a result transportation, assembly and disassembly of the enclosure may be common. The prior art systems require extensive manpower for assembly and disassembly. When disassembled, loose parts can be lost and transport and storage is cumbersome and difficult. To assemble, tools and excessive know-how and manpower are needed. When assembled, excessive bulk prevents easy transport and storage.

There is a need, therefore, for an improved system which permits easy assembly, disassembly, storage and transport and aids in assuring adequate restraint and monitoring of patients.

SUMMARY OF THE INVENTION

The present invention is directed to a collapsible enclosure for restraining a patient to an area about a bed, including a frame having a horizontal eave portion, a horizontal base portion opposing the horizontal eave portion and at least two vertical members upstanding from the horizontal base portion for supporting the horizontal eave portion, wherein for storage and transport the frame collapses as an integral unit. A canopy assembly secures to the frame for defining an area about a bed such that the patient is allowed to move freely within the area.

In a currently preferred embodiment, the enclosure for restraining a patient to an area about a bed includes a frame for surrounding a bed. The frame has an upper laterally extending support and first and second upstanding supports for supporting the upper laterally extending support, wherein for storage and transport the frame folds compactly. A canopy assembly is secured to the frame for defining an area about the bed such that a patient is allowed to move freely within the area.

Accordingly, it is an object of the subject invention to provide an enclosure which is easily assembled, disassembled, transported, stored and cleaned.

It is an object of the subject invention to provide for safe restraint of a patient to an area yet still allow for free and comfortable movement within the area.

It is another object of the subject invention to provide a restraining enclosure which permits effective visual monitoring of the patient with the area of retention.

It should be appreciated that the present invention can be implemented and utilized in numerous ways, including without limitation as a process, an apparatus, a system, a device and a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings wherein.

DETAILED DESCRIPTION OF THE PREFERRED EMBODIMENTS

Figure 1:
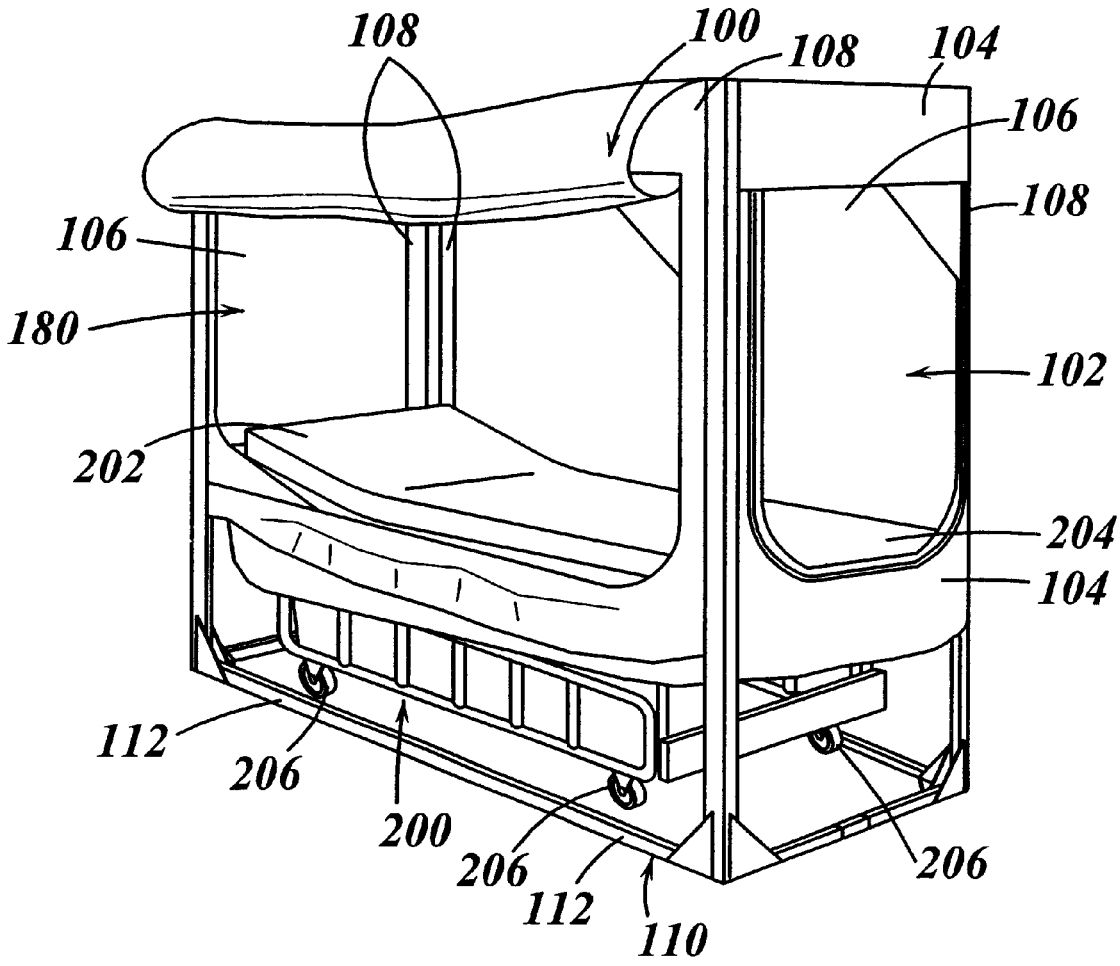
FIG. 1 illustrates a collapsible patient restraining enclosure for a bed constructed in accordance with subject invention, and in particular the restraining enclosure positioned about a bed.

The present invention overcomes many of the prior art problems associated with enclosures for restraining patients to a bed area. The advantages, and other features of the system disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

The subject enclosure safely confines a patient to an area defined around a bed. However, the patient is free to move within the area about the bed. Caregivers and attendants can see into the restrained area as well as access the patient through selectively fastenable openings. The patient has the ability to see and interact with the general environment around the enclosure. When not in use, the enclosure can be collapsed for easy storage and transport.

Referring to FIG. 1, a collapsible enclosure 100 confines a person to their bed 200 without restraints. Typically, the enclosure 100 would be used in a hospital environment with a standard hospital bed 200. The enclosure 100 has a unitary aluminum frame 110 which defines an area of restraint about the bed 200. It is envisioned that the frame 110 can be fabricated from a variety of materials now known and later developed such as steel, PVC pipe, aluminum, plastics, carbon fiber composite, other metals and the like, alone or in combination, to create a suitably robust and lightweight frame 110. In one embodiment, the frame 110 has casters for moving the frame 110.

A canopy 102 is draped about the frame 110 and secured in place to prevent a person from leaving the area of restraint. The canopy 102 leaves access to a portion of the bed 200 for adjustment thereto. The canopy 102 can be secured in place on or over the frame 110 by zippers, fabric sleeves which slide over the frame components, velcro and the like or combinations thereof as would be appreciated by those of ordinary skill in the art based upon review of the subject disclosure. Zippers 108 allow movement of portions of the canopy 102 to allow access to the area of retention. Preferably, all of the zippers used on canopy 102 are self-locking.

In one embodiment, the canopy 102 drapes on the inside of the frame. Preferably, the canopy 102 is fabricated from a combination of vinyl or nylon portions 104 and netting 106. In a preferred embodiment, the netting 106 is black nylon netting. The advantage of the black color as well as brown, blue and the like is that dark colors allow for improved see-through capability and greater stain resistance. Further, nylon material is substantially lighter than vinyl and therefore easier to handle.

Figure 2A:
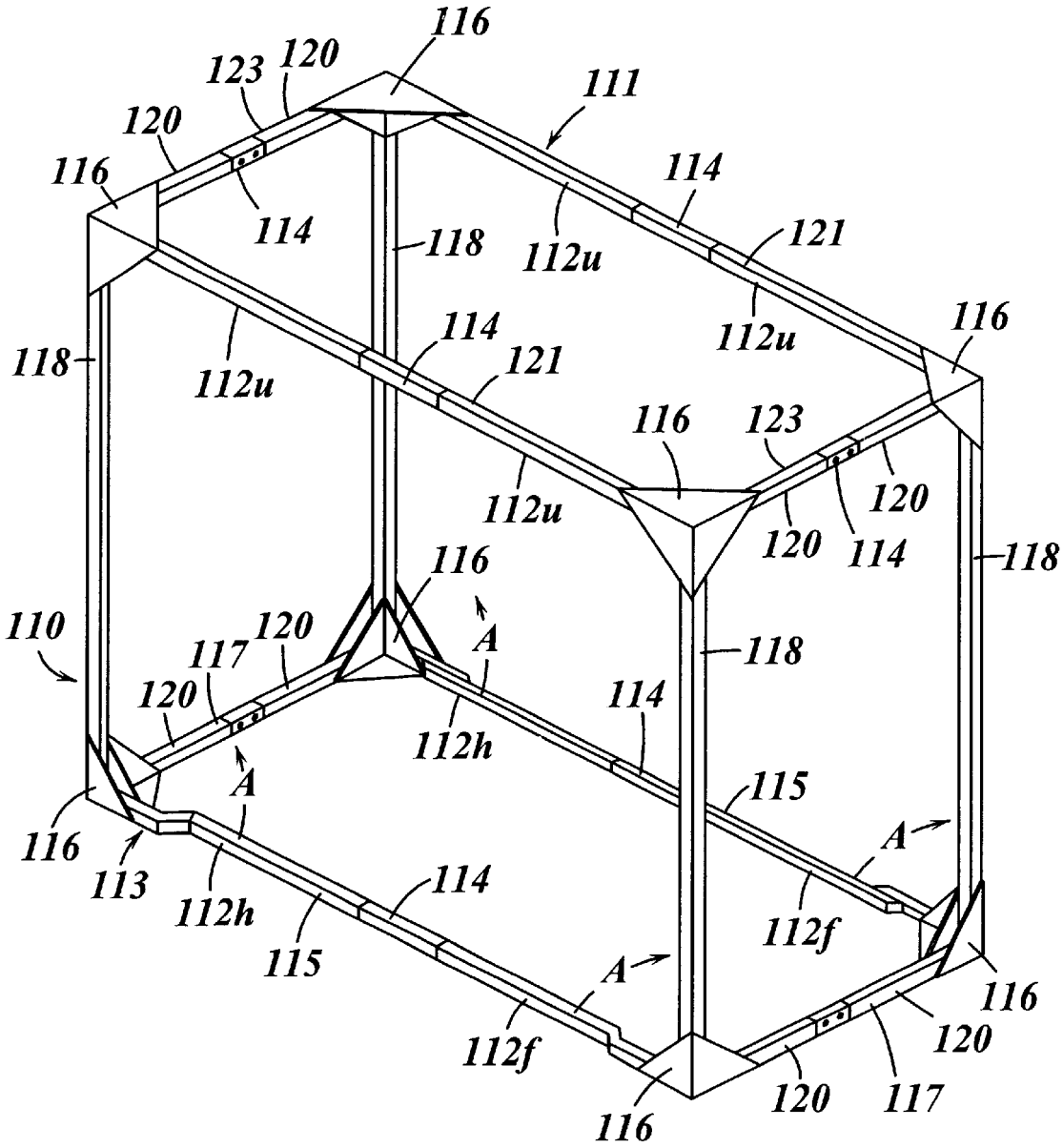
FIG. 2A is a perspective view of an assembled frame of the restraining enclosure of FIG. 1.
Figure 2B:
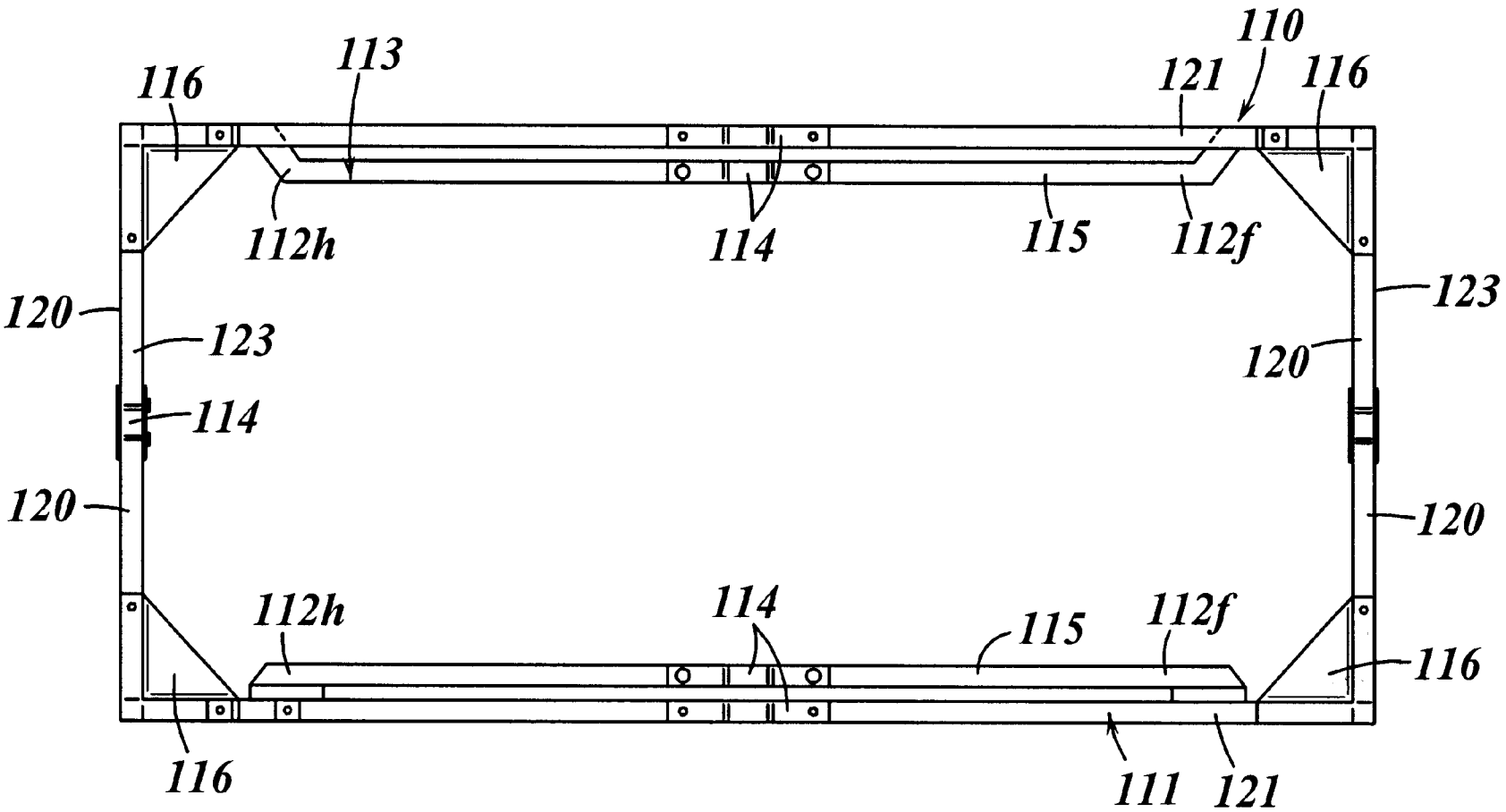
FIG. 2B is a bottom plan view of the assembled frame of FIG. 1.

Now referring to FIGS. 2A and 2B, the frame 110 includes an eave portion 111 supported above a base portion 113 by four vertical bars 118. When assembled, the frame 110 is rigid and supported on the floor by the base portion 113. The bed 200 within the enclosure 100 has a head 202 and a foot 204 (see FIG. 1), thus, the frame 110 has a corresponding head end and foot end, respectively, although the frame 110 as shown is symmetrical. Preferably, the strength and stability of the frame 110 is such that an adult could robustly attempt exit without damage to the frame 110 or tipping the frame 110 over.

The base portion 113 has two non-linear substantially parallel elongated supports 115, each support 115 having a head portion 112*h* and a foot portion 112*f*. The head portion 112*h* and the foot portion 112*f* are linked by a coupling 114. Two parallel transverse supports 117 extend between the non-linear supports 115 to substantially form a rectangle approximately the size of a standard hospital bed 200. The transverse supports 117 include two portions 120 linked by a coupling 114. Traditionally, the standard hospital bed 200 is approximately 90.25×36.64 inches although it will be appreciated that the enclosure 100, in particular the rectangle formed by the base portion 113 and eave portion 111, is well suited to adaptation to beds of any size.

Four lower corner brackets 116 secure the elongated supports 115 and transverse supports 117 of the base portion 113 in such a manner that both supports 115, 117 can selectively rotate. Preferably, each coupling 114 is pivotably connected and located intermediate each support 115, 117 for facilitating collapsing the frame 110 as will be described hereinbelow with respect to FIGS. 4 and 5. The central region of the elongated supports 115 of the base portion 113 is offset towards the interior of the enclosure 100 for facilitating collapsing the enclosure 100 as well.

The eave portion 111 is supported above the base portion 113 by four vertical, parallel rectangular bars 118. Two linear parallel elongated supports 121 extend between a head end and a foot end of the eave portion 111. Two parallel transverse supports 123 extend between the elongated supports 121 to form a rectangle therewith approximately the size of a standard hospital bed 200. Four upper corner brackets 116 secure the supports 121, 123 of the eave portion 111 in such a manner that each of the supports can selectively rotate downward therefrom. Preferably, each of the supports 121, 123 of the eave portion 111 has pivot devices 114 located intermediate their length for facilitating collapsing the frame 110.

Still referring to FIGS. 2A and 2B, when assembled, the corner brackets 116 rigidly secure the four vertical bars 118 thereto. In another embodiment, the four vertical bars 118 are integral with the corner brackets 116. In another embodiment, the supports 121, 123 of the eave portion 111 are monolithic and selectively detach from the corner brackets 116 for partial disassembly. In still another embodiment, the head end and the foot end of the eave portion 111 are supported above the base portion 113 by two solid panels as would be appreciated by those of ordinary skill in the pertinent art based upon review of the subject disclosure shown in phantom line on FIG. 4. In yet still another embodiment, only elongated or transverse parallel pairs of parallel supports of the eave and base portions include pivoting couplings 114, thus the frame only partially collapses.

In order to position the bed 200 within the enclosure 100, the head end 112*h* and the foot end 112*f* of the base portion can be disconnected at an intermediate point via coupling 114 and rotated upwards along arrow A. Since the bed 200 is commonly mounted on wheels 206, the bed 200 can be rolled into the enclosure 100 without interference. Upon positioning the bed 200 within the enclosure 100, the head end 112*h* and the foot end 112*f* are rotated downwards and secured together with coupling 114. At such time, a mattress is placed inside the canopy 102 and the patient may be placed in the bed 200 and the canopy 102 secured in place. Alternatively, the canopy 102 may be secured in place about the frame 110 and the patient may enter the restraining area through an opening 180 in the canopy 102. In another embodiment, there is no base portion. In one embodiment without a base portion, the four vertical bars 118 would terminate in foot plates. In another embodiment, the four vertical bars 118 terminate in a post adapted and configured for insertion in the headboard and footboard slots of a standard hospital bed 200. Thus, to erect the enclosure about the bed 200, the headboard and footboard are removed and the four vertical bars are inserted therein. Alternatively, the four vertical bars could bolt onto a bed or an adapter plate could facilitate secure locking engagement to a bed.

Referring to FIGS. 3A through 3D, a corner bracket 116 has a base component 140 and an upper component 142 which are preferably made from metal and welded or riveted together. The base component 140 has a substantially triangular platform 148 with two upstanding triangles 149 on edges thereof. The two upstanding triangles 149 define a channel 151 for receiving a portion of a vertical bar 118. The upper component 142 has a flange 143 for engaging the base component 140 and two upstanding triangles 145. The vertical bars 118 are also welded or riveted fixed securely to the corner brackets 116. An angle iron 144 is welded or riveted to the upper component 142 and vertical bar 118 for additional support, fit and rigidity. It is envisioned that the vertical bars 118, base component 140, upper component 142 and angle iron 144 may be of monolithic construction, riveted, screwed, glued or the like, in order to form a desired shape which performs the necessary function. In another embodiment, instead of an angle iron 144 for extra structural support, the shape of the corner brackets 166 is modified to conform to the vertical bar 118 for fixedly securing the vertical bar 118 thereto.

Figure 3A:
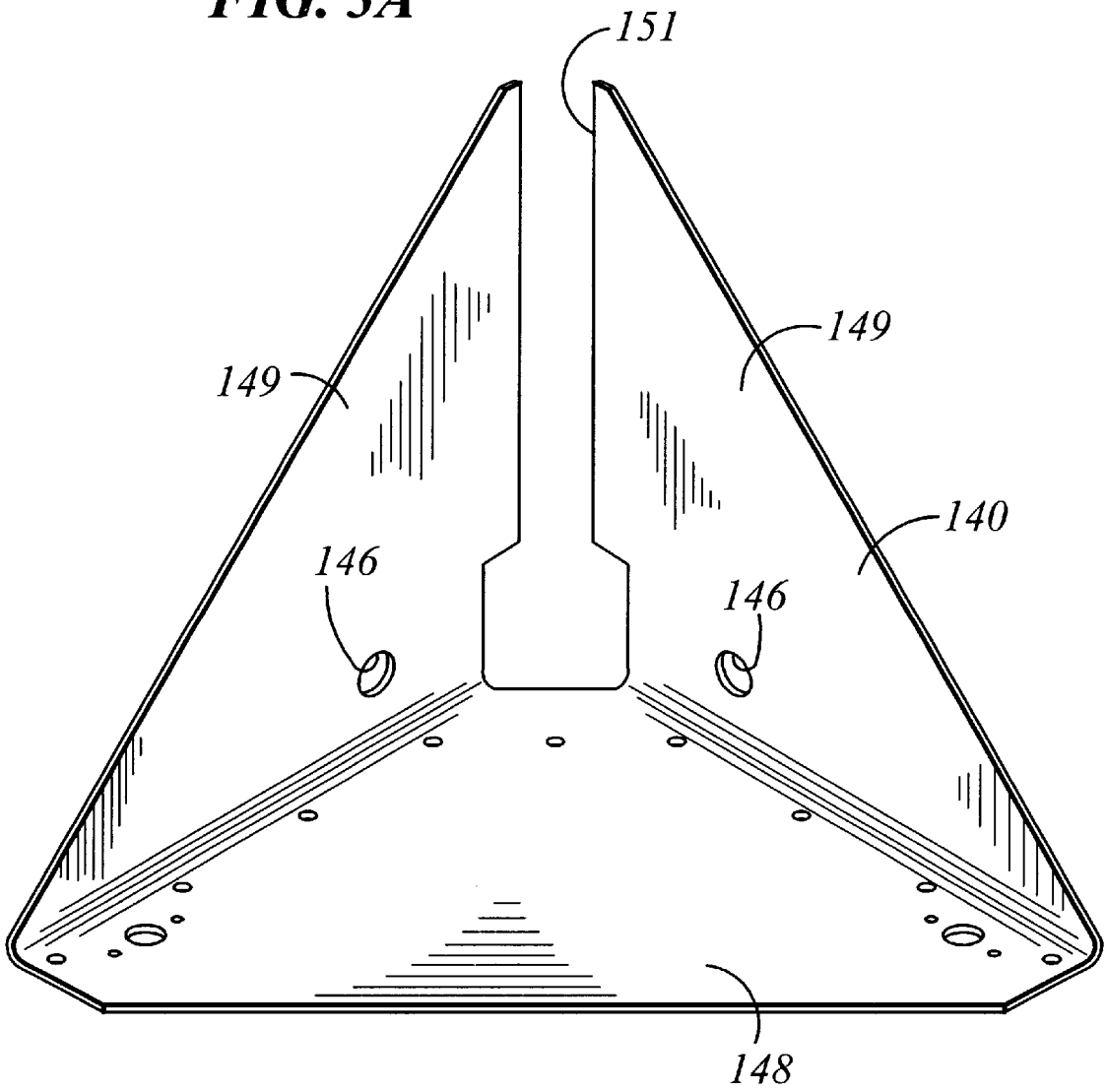
FIG. 3A is a perspective view of an outer portion of a corner bracket of the frame of FIG. 1.
Figure 3B:
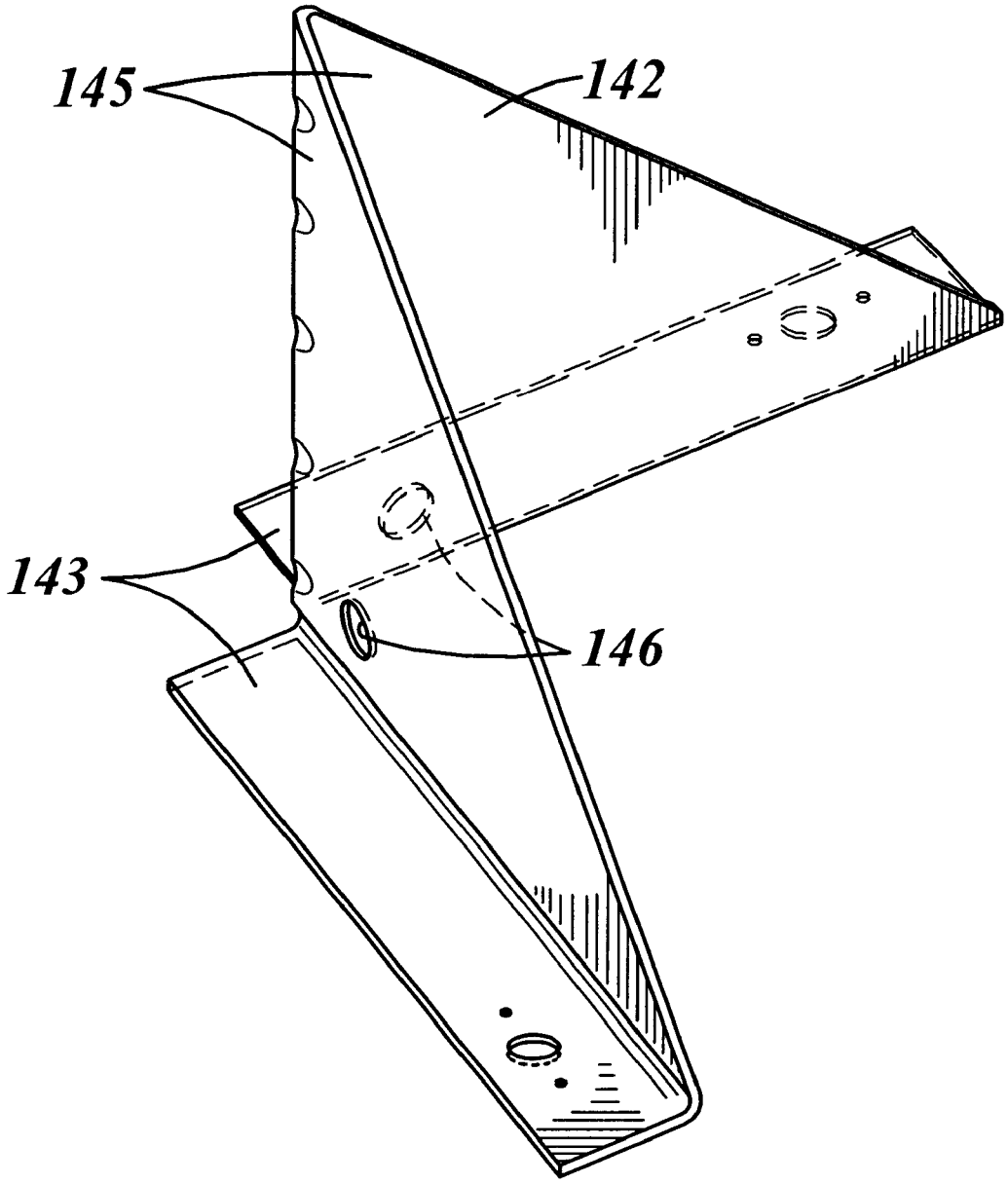
FIG. 3B is a perspective view of an inner portion of a corner bracket of the frame of FIG. 1.
Figure 3C:
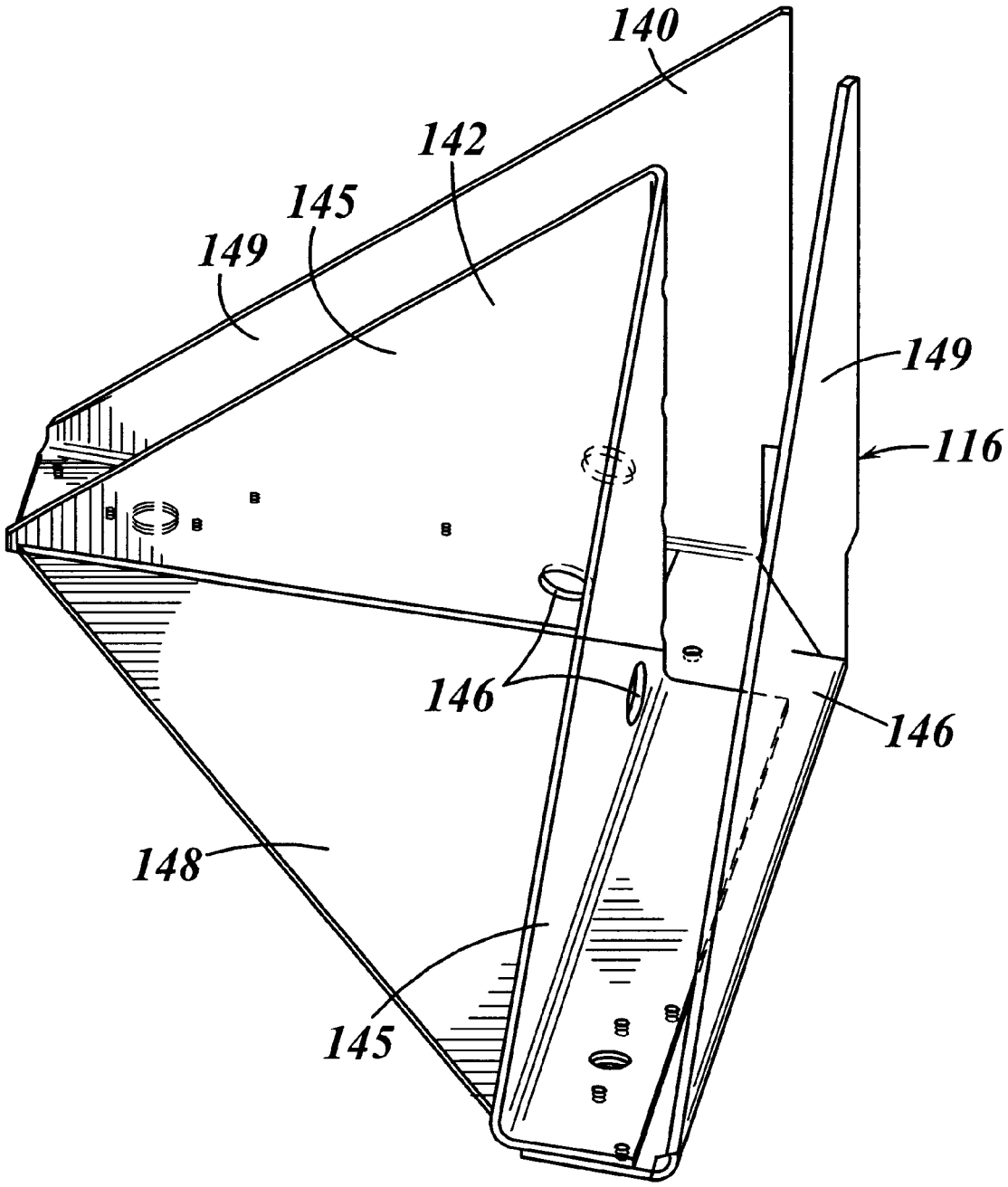
FIG. 3C is a perspective view of a partially assembled corner bracket of the frame of FIG. 1.
Figure 3D:
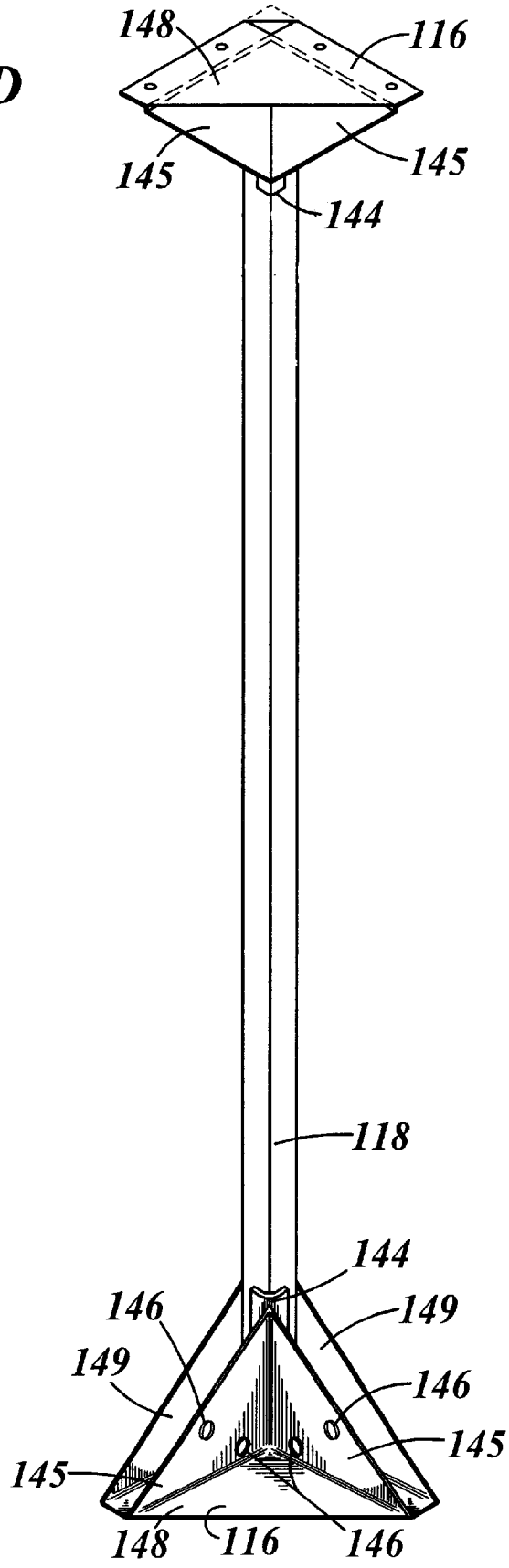
FIG. 3D is a perspective view of two partially assembled corner brackets secured to a vertical bar of a frame of the restraining enclosure of FIG. 1.
Figure 3E:
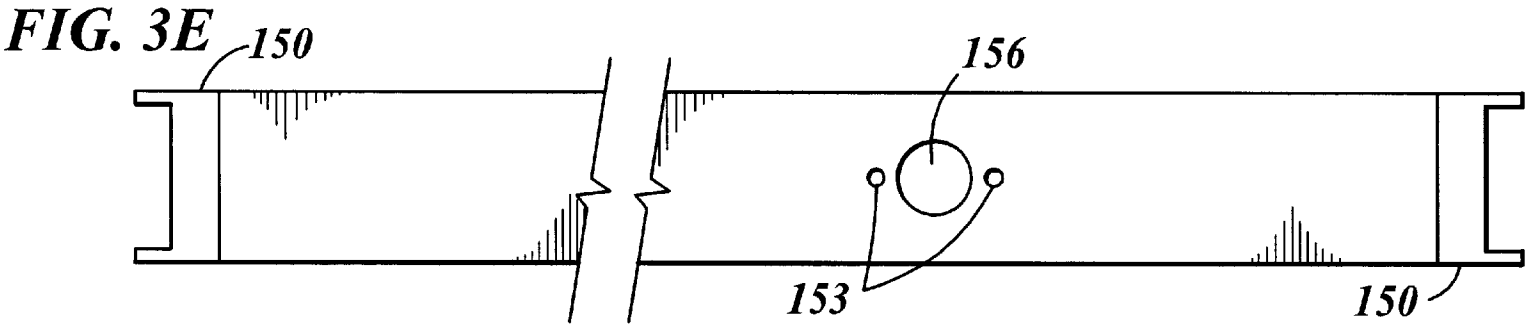
FIG. 3E is a top view of an end of a support of the frame of FIG. 1.
Figure 3F:
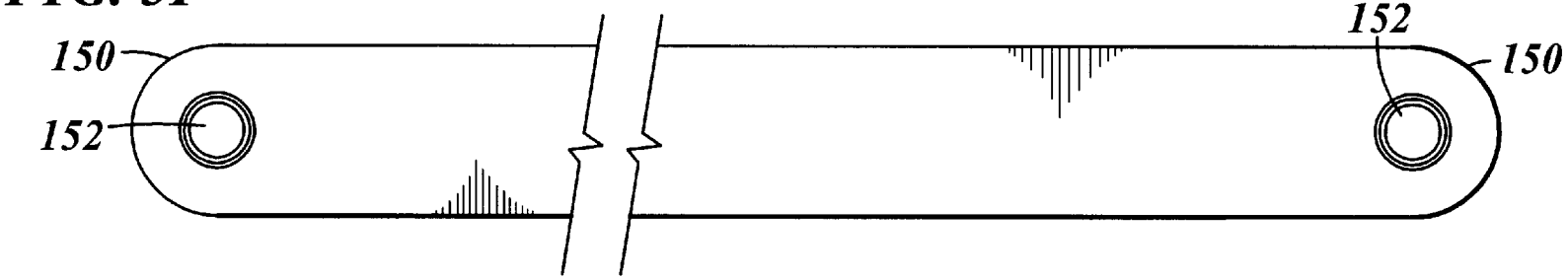
FIG. 3F is a bottom view of an end of a support of the frame of FIG. 1.
Figure 3G:
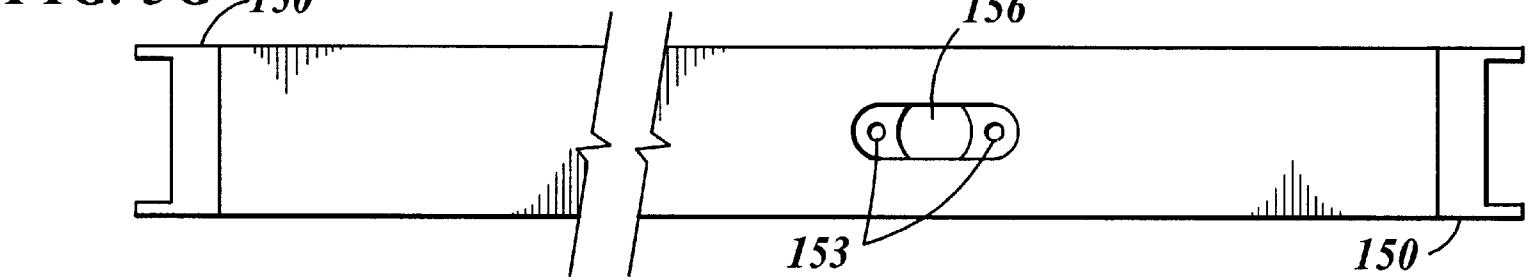
FIG. 3G is a side view of an end of a support of the frame of FIG. 1.
Figure 3H:
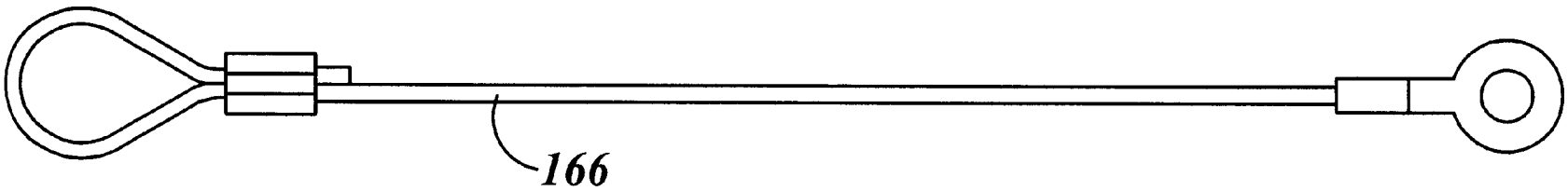
FIG. 3H is a perspective view of a tether of the restraining enclosure of FIG. 1.
Figure 3J:
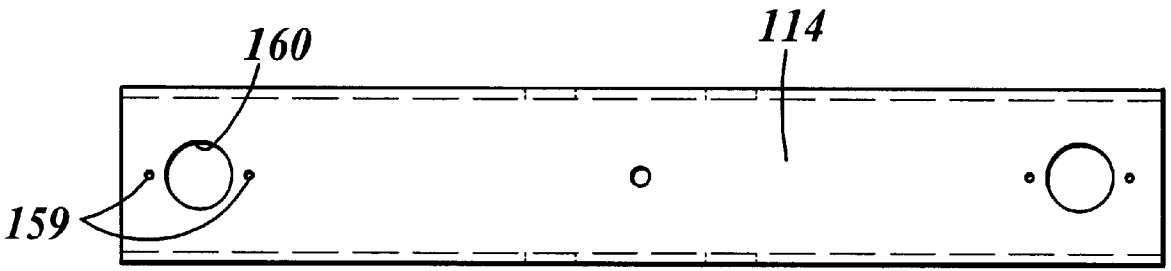
FIG. 3J is a side end view of a coupling of the frame of FIG. 1.
Figure 3I:
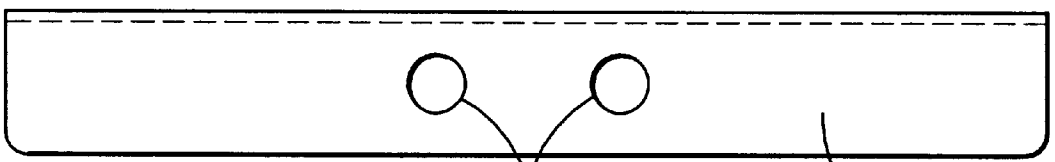
FIG. 3I is a top view of a coupling of the frame of FIG. 1.
Figure 3K:
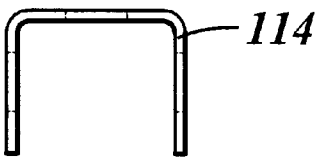
FIG. 3K is an end view of a coupling of the frame of FIG. 1.
Figure 3L:
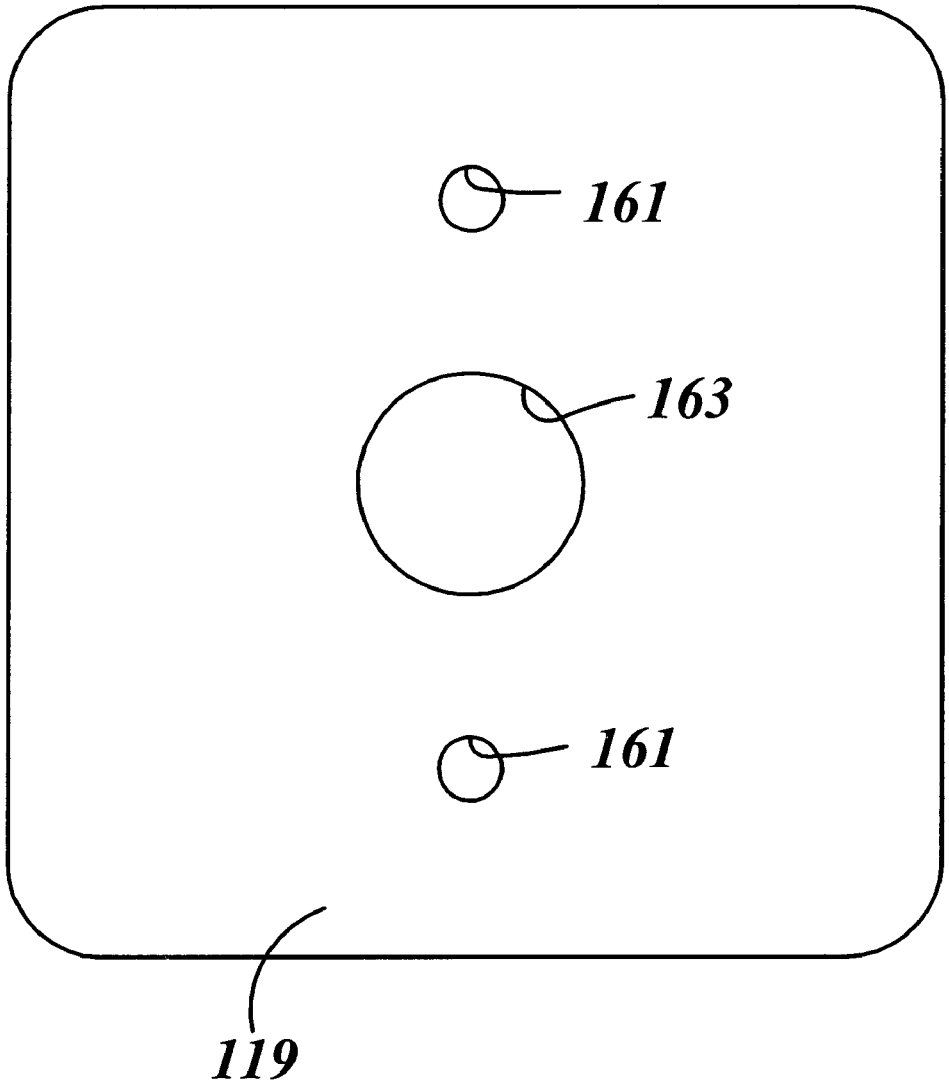
FIG. 3L is a plan view of a nut plate of the frame of FIG. 1.

Referring now to FIGS. 3E through 3H, the ends 150 of the supports 115, 117, 121, 123 of the base portion 113 and eave portion 111 rotatably couple to the corner brackets 116. Preferably, the ends 150 of the supports are rounded and define a pivot passage 152 for receiving a pin (not shown) as best shown in FIG. 3F. The pin also extends through holes 146 formed in the corner brackets 116. The pin may be held in place by a cotter pin and the like and secured to the frame 110 by a nylon coated stainless steel tether 166 as shown in FIG. 3H. In one embodiment, a teflon bushing is inserted in the pivot passage 152 to enhance the smooth rotation and wear characteristics. A locking fastener (not shown) such as a captive screw secures the supports 115, 117, 121, 123 rigidly to the corner brackets 116 for assembly. Preferably, the locking fastener extends through aligned holes (not shown) in the supports 115, 117, 121, 123 and corresponding corner brackets 116. The aligned holes may be threaded or a nut and bolt combination may be used to fix the supports 115, 117, 121, 123.

Referring to FIGS. 3E through 3L, couplings 114 selectively rotatably or rigidly secure together the intermediate ends of the supports 115, 117, 121, 123. A pivot pin (not shown) rotatably secures the intermediate ends 150 of the supports 115, 117, 121, 123 to the couplings 114 by extending through holes 152 in the supports 115, 117, 121, 123 and opening 158 in the couplings 114. To fix the supports 115, 117, 121, 123 rigidly, a pin and fasteners (not shown) extend through holes 160, 159 of the coupling 114, respectively, into holes 156, 153, respectively, of the supports 115, 117, 121, 123. Preferably, a pair of nut plates 119 spreads the connection force over an area of the supports 115, 117, 121, 123. For example, the pins extend into openings 163 on the nut plates 119 and the nut plates 119 are held in place about each side of the channel 156 of end 150 by the fasteners which pass through holes 161 of one of the nut plates 119 and thread into the opposing nut plate 119 by corresponding holes 161. Preferably, the pins and fasteners have locking rings to facilitate captive engagement with the nut plates 119 to prevent loss when disassembled and to provide efficient storage thereof. In another embodiment, teflon bushings (not shown) are pressed into the central openings 156 to alleviate the need for exceptionally tight tolerancing for a snug fit.

Figure 4:
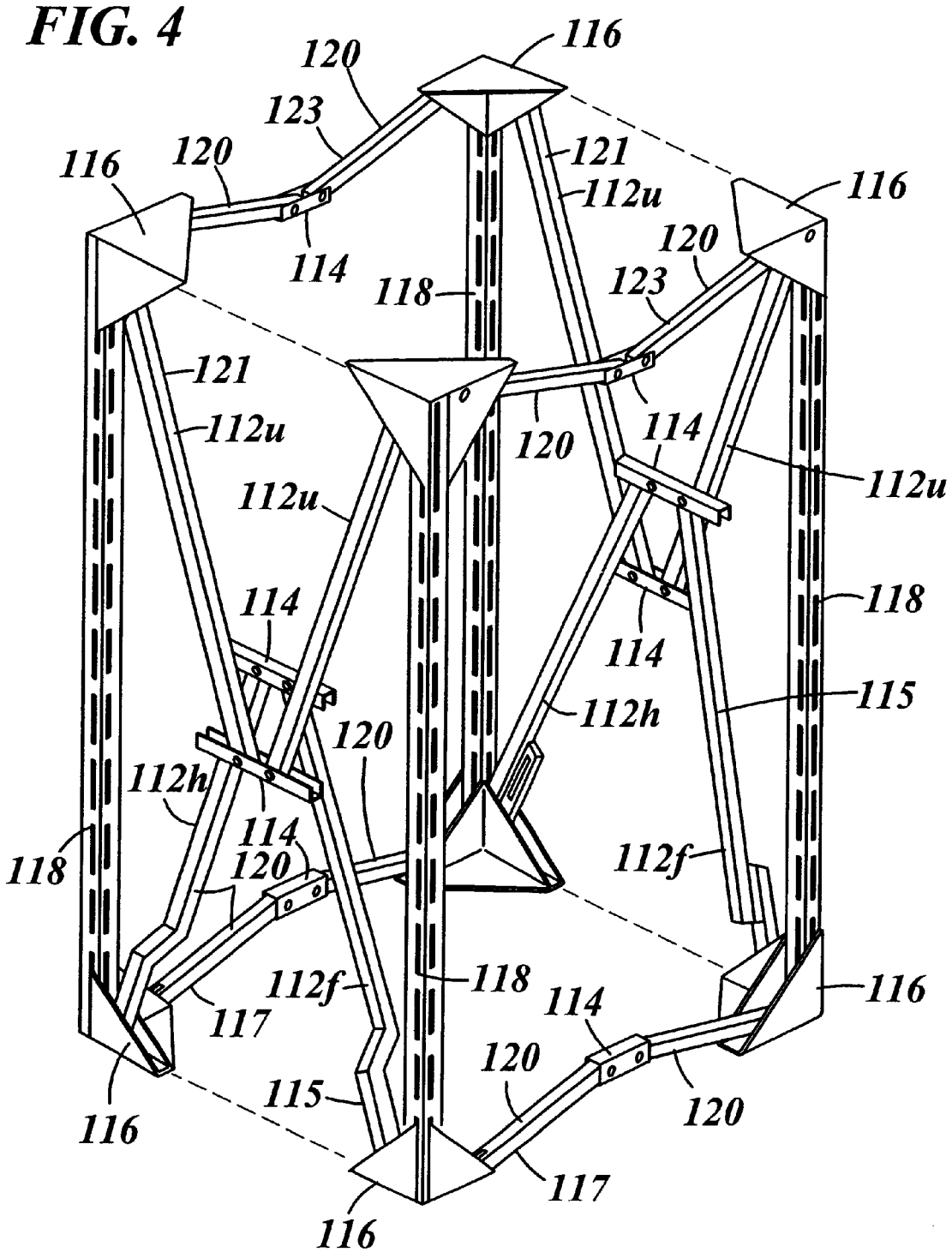
FIG. 4 is a perspective view of the frame of FIG. 1 in a partially collapsed state.
Figure 5:
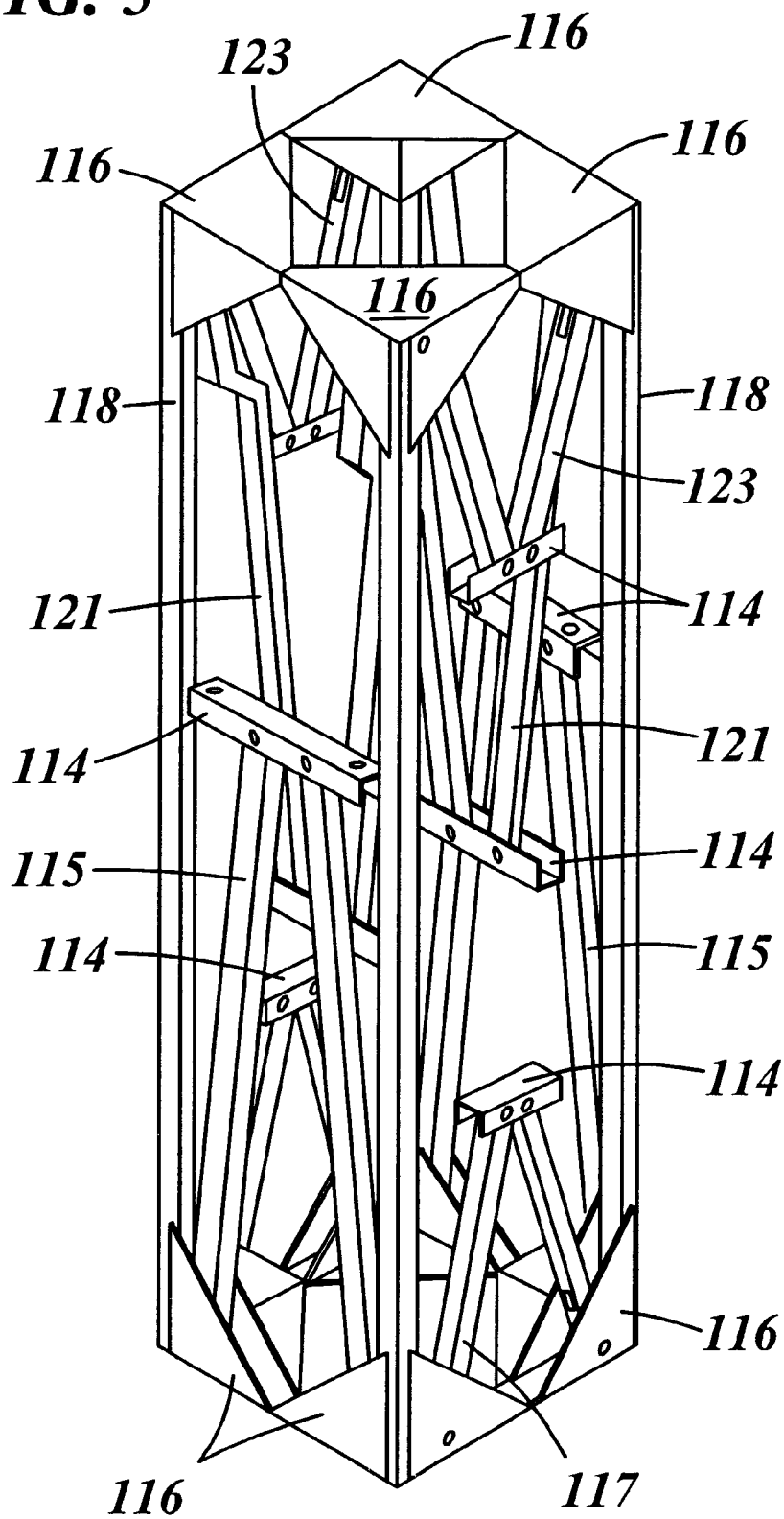
FIG. 5 is a perspective view of the frame of FIG. 1 in a fully collapsed state.

Referring to FIGS. 4 and 5, the corner brackets 116 and the couplings 114 of the frame 110 have been released to allow collapsing the frame 110 for transportation and storage. Upon release, the four vertical bars 118 remain upright and are brought together. As the four vertical bars 118 are brought together, each of the supports 115, 117, 121, 123 pivotally hinges at the corner bracket 116 on one end and at the coupling 114 on the inner end. The height of the four bars 118 is selected such that the inner ends of the transverse supports 123 of the eave portion 111 and the inner end of the transverse supports 117 of the base portion 113 do not overlap. However, the inner ends of the elongated supports 121 of the eave portion 111 and the inner ends of the elongated supports 115 of the base portion 113 do overlap. To accommodate the overlap, the non-linear shape of the elongated support members 115 of the base portion 113 prevent interference between the central region of the eave portion's elongated supports 121 and the base portion's elongated supports 115 when fully collapsed. As a result, the frame 110 can be minimized for storage and transport as shown in FIG. 5. Preferably, a strap (not shown), attached to the frame 110, is used to secure the frame 110 in the minimized position. In another embodiment, the collapsed frame 110 is stored within a transport bag. It will be appreciated by those skilled in the pertinent art based upon review of the subject disclosure that the frame 110 may be collapsed with the canopy 102 in place.

Figure 6:
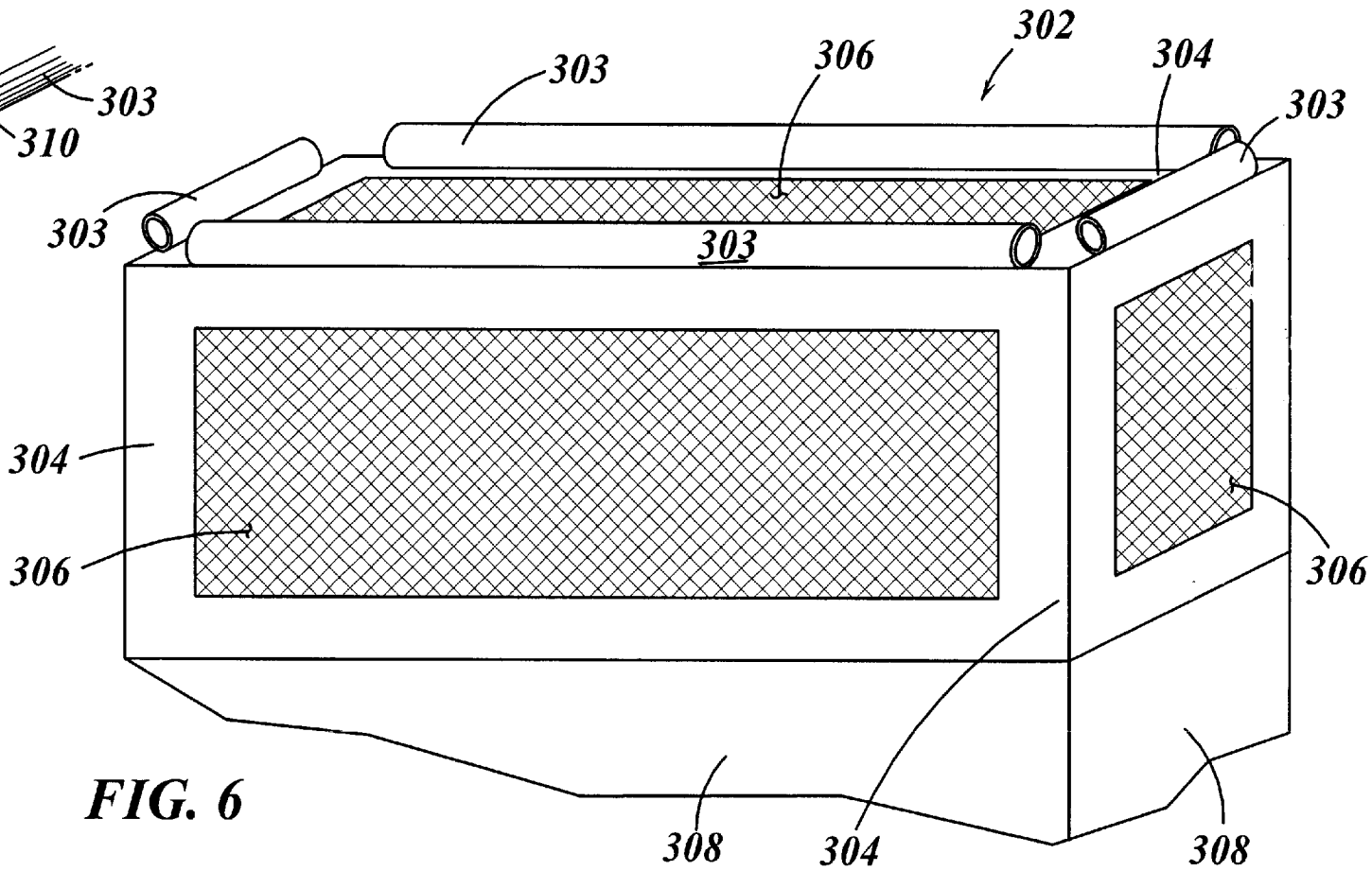
FIG. 6 is a perspective view of a canopy for another embodiment of an enclosure constructed in accordance with the subject invention.
Figure 7:
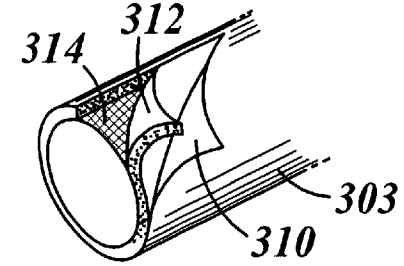
FIG. 7 is a partially disassembled view of a sleeve of the canopy of FIG. 6.

Referring to FIGS. 6 and 7, another embodiment of a canopy for an enclosure of the present invention is indicated generally by the reference numeral 302. The canopy 302 is similar to the canopy 102 described above, and therefore like reference numerals preceded by the numeral "3" instead of the numeral "1" are used to indicate like elements. The canopy 302 drapes down from the eave portion 111 of the frame 110 by sleeves 303. The canopy 302 leaves access to a portion of the bed for adjusting the bed. Preferably, the canopy 302 has zippers (not shown) in lower panels 308 to provide such access as would be well within the skill of one in the pertinent art. The sleeves 303 are fabricated from a combination of nylon 310, foam 312 and mesh 314. The foam 312 acts as padding for the frame 110. In a preferred embodiment, the foam 312 is a closed cell padding material to prevent water absorption and the mesh 314 allows water drainage and drying after the canopy 302 has been washed. In another embodiment, sleeves are provided for securing the canopy 302 to the vertical bars 118 of the frame 110 as well.

Figures 8A, 8B:
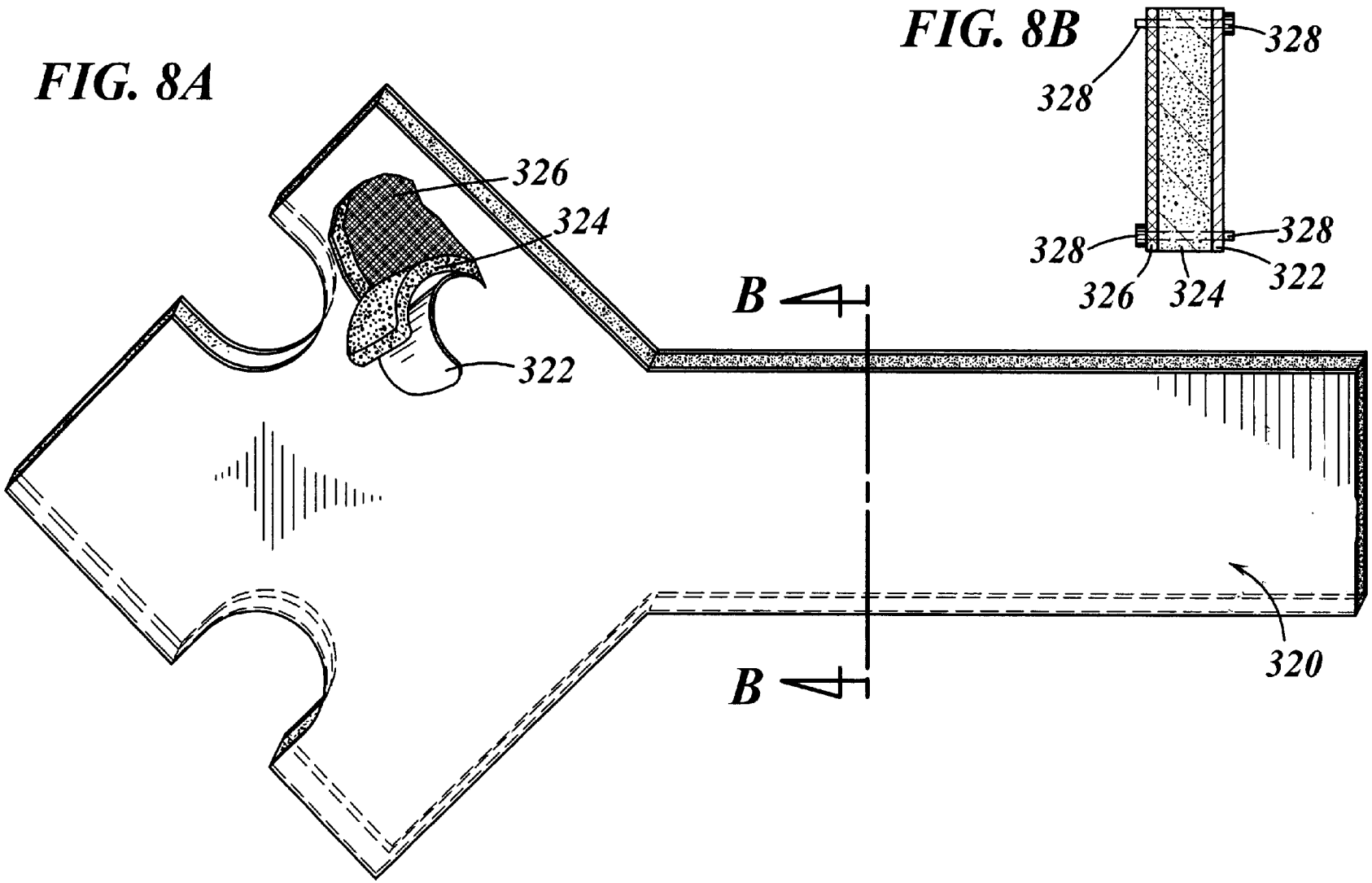
FIG. 8A is a partially disassembled view of an exemplary collar assembly for use with the canopy of FIG. 6.
FIG. 8B is a cross-sectional view of the collar assembly of FIG. 8A taken along line B—B.

Referring to FIGS. 8A and 8B, a collar assembly 320 is fitted to each vertical bar 118 to prevent injury to the restrained patient. Additional collar assemblies 320 may be fitted and used to cover any portion of the frame which may pose potential for injury to a patient. The collar assemblies are also composed of nylon 322, foam 324, mesh 326 and fasteners 328 to allow for easy maintenance, assembly and protection of the patient from injury against the frame 110. The collar assemblies 320 are contoured for snugly and aesthetically fitting against the frame 110. The fasteners 328 are used to insure a snug fit of the collar assemblies 320 onto the frame 110. Preferably, the fasteners 328 are hook and loop fabric pairs.

As would be appreciated by those of ordinary skill in the pertinent art, upon review of the subject disclosure, the figures and associated detailed description are representative of preferred embodiments and various modifications can be made thereto. While the invention has been described with respect to preferred embodiments, those skilled in the art will readily appreciate that various changes and/or modifications can be made to the invention without departing from the spirit or scope of the invention as disclosed herein and as claimed.

What is claimed is:

1. An enclosure for restraining a patient to an area about a bed, wherein the bed is adapted to support the patient, comprising:

a removable and collapsible frame adapted to surround the bed and to be positioned on a surface supporting the bed, the frame having:

an upper laterally extending support;

a first upstanding support coupled to a first side of the upper laterally extending support; and a second upstanding support coupled to a second side of the upper laterally extending support, wherein at least one of the first upstanding support, the second upstanding support and the upper laterally extending support is movable relative to at least one of the other supports for folding the frame for transport or storage; and a canopy connectable to the frame for defining an area about the bed such that a patient is allowed to move freely within the area, and including at least one access portion movable between a closed position and an open position defining an opening through the canopy for allowing access to the patient area, and at least one see-through portion for permitting visual monitoring of the patient area from outside of the canopy.

2. An enclosure as recited in claim 1, wherein the first and second upstanding supports are pivotally coupled to the upper laterally extending support such that the upper laterally extending support folds compactly relative to the first and second upstanding supports.

3. An enclosure as recited in claim 1, further comprising:

corner brackets for pivotally coupling the upper laterally extending support to the first and second upstanding supports; and at least one coupling intermediate the sides of the upper laterally extending support, such that the first side of the upper laterally extending support is foldable toward the first upstanding support and the second side of the upper laterally extending support is foldable toward the second upstanding support.

4. An enclosure as recited in claim 3, wherein the upper laterally extending support includes upper transverse members, the upper transverse members having couplings for rigidly fixing and folding the upper transverse members.

5. An enclosure as recited in claim 1, wherein the frame further comprises a lower laterally extending support opposing the upper laterally extending support.

6. An enclosure as recited in claim 5, wherein the frame further comprises a coupling for pivoting at least a portion of the lower laterally extending support to define an opening for moving a bed therethrough.

7. An enclosure as recited in claim 5, further comprising:

corner brackets for pivotally coupling the lower laterally extending support to the first and second upstanding supports; and a pair of couplings intermediate each end of the lower laterally extending support, such that a first side of the lower laterally extending support folds compactly toward the first upstanding support and a second side of the lower laterally extending support folds compactly toward the second upstanding support, and wherein an elongated portion of the lower laterally extending support is laterally offset with respect to an elongated portion of the upper laterally extending support for allowing overlap therebetween when folding the frame.

8. An enclosure as recited in claim 1, further comprising a plurality of zippers for securing the canopy assembly to the frame, wherein at least one zipper is connected to the access portion for closing the access portion by closing the zipper, and for opening the access portion by opening the zipper and allowing access to the patient area.

9. An enclosure as recited in claim 1, further comprising third and fourth upstanding supports for supporting the upper laterally extending support, wherein each upstanding support is in a respective corner of the frame.

10. An enclosure as recited in claim 1, wherein the frame supports the canopy within an interior thereof.

11. An enclosure as recited in claim 1, wherein the see-through portion of the canopy is fabricated at least partially from dark netting for allowing seeing into and out of the patient area.

12. An enclosure as recited in claim 1, wherein the see-through portion of the canopy includes means for forming a mesh and allowing high visibility from outside the canopy therethrough and resistance to staining.

13. An enclosure as recited in claim 12, wherein said means is a dark colored netting.

14. An enclosure as recited in claim 13, wherein the color of the netting is selected from the group including black, brown and blue.

15. An enclosure as recited in claim 1, wherein the see-through portion is defined by a dark colored mesh.

16. An enclosure as defined in claim 15, wherein the color of the mush is selected from the group including black, blue and brown.

17. An enclosure as recited in claim 1, wherein the upper laterally extending support includes two laterally extending upper support members spaced relative to each other, and two transversely extending upper support members connected between the laterally extending upper support members, and wherein each upper support member includes a coupling for permitting opposing sides of the respective support member to be pivotally moved between open and collapsed positions.

18. An enclosure as recited in claim 17, further comprising a lower laterally extending support opposing the upper laterally extending support, and wherein the lower laterally extending support includes two laterally extending lower support members spaced relative to each other, and two transversely extending lower support members connected between the laterally extending lower support members, and wherein each lower support member includes a coupling for permitting opposing sides of the support member to be pivotally moved between open and collapsed positions.

19. An enclosure as recited in claim 18, wherein at least one of the laterally extending lower support members is spaced transversely relative to the opposing laterally extending upper support member to permit the respective upper and lower support members to overlap when moving between open and collapsed positions.

20. An enclosure as recited in claim 19, wherein the canopy is foldable with the frame between open and collapsed positions.

21. An enclosure as recited in claim 18, wherein the laterally extending upper and lower support members are pivotal toward each other, and the transversely extending upper and lower support members are pivotal, toward each other, to collapse the frame.

22. An enclosure as recited in claim 1, wherein the canopy includes at least one mounting sleeve receiving therein at least a portion of the upper laterally extending support for supporting the canopy thereon.

23. An enclosure as recited in claim 22, wherein the mounting sleeve includes an outer polymeric layer, an inner mesh layer, and a foam layer between the outer polymeric layer and inner mesh layer.

24. An enclosure as recited in claim 1, wherein the upper laterally extending support includes a plurality of support members, and the canopy comprises a plurality of mounting sleeves, wherein each mounting sleeve receives therein a support member for supporting the canopy on the upper laterally extending support.

25. An enclosure as recited in claim 24, wherein the upper laterally extending support includes two elongated support members spaced relative to each other, and two transversely extending support members coupled between the elongated support members, and the canopy further comprises a plurality of mounting sleeves, wherein each mounting sleeve receives therein a support member for supporting the canopy on the upper laterally extending support.

26. An enclosure as recited in claim 24, wherein each mounting sleeve includes an outer polymeric layer, an inner mesh layer, and a foam layer between the outer polymeric layer and inner mesh layer.

27. An enclosure as recited in claim 1, wherein the canopy further comprises at least one collar coupled to and covering at least a portion of an upstanding support.

28. An enclosure as recited in claim 27, wherein each collar includes an outer polymeric layer, an inner mesh layer, and a foam layer between the outer polymeric layer and inner mesh layer.

29. An enclosure as recited in claim 28, wherein the canopy includes a plurality of collars covering at least portions of the first and second upstanding supports for protecting the patient against injury from the frame.

30. An enclosure as recited in claim 1, further comprising a lower laterally extending support opposing the upper laterally extending support, and wherein the lower laterally extending support includes a lower laterally extending support member and a coupling for permitting opposing sides of the lower laterally extending support member to be pivotally moved between open and collapsed positions.

31. An enclosure as recited in claim 30, wherein at least one side of the lower laterally extending support member releasable from the coupling for pivoting the respective side of the lower laterally extending support member relative to at least one upstanding support to define a passage within the frame for moving a bed therethrough.

32. An enclosure for restraining a patient to a bed, wherein the bed is adapted to support the patient, comprising:

a removable and collapsible frame adapted to surround the bed and to be positioned on a surface supporting the bed, including:

a plurality of elongated upper supports having a first portion and a second portion with a pivotable coupling spaced between the first portion and the second portion of each elongated upper support;

a plurality of transverse upper supports coupled to the elongated upper supports;

a plurality of elongated base supports having a first portion and a second portion with a pivotable coupling spaced between the first portion and the second portion of each elongated base support;

a plurality of transverse base supports coupled to the elongated base supports;

a plurality of upstanding supports for supporting the elongated and transverse upper supports above the elongated and transverse base supports, respectively, each upstanding support having an upper end and a base end;

a plurality of upper connectors for movably connecting the upper ends of the upstanding supports with the elongated and the transverse upper supports to form a plurality of upper corners such that the upper ends of the upstanding supports, the elongated upper supports and the transverse upper supports are fixable relative to one another in use, and foldable relative to one another for storage; and a plurality of base connectors for movably connecting the base ends of the upstanding supports with the elongated and the transverse base supports to form a plurality of base corners such that the base ends of the upstanding supports, the elongated base supports and the transverse base supports are fixable relative to one another in use, and foldable relative to one another for storage; and a canopy connectable to the frame for defining an area about the bed such that a patient is allowed to move freely within the area, wherein the canopy includes at least one access portion for allowing access to the patient area, and at least one see-through portion for permitting visual monitoring of the patient from outside of the canopy.

33. An enclosure as recited in claim 32, wherein each elongated base support is at least partially laterally offset with respect to a respective elongated upper supports.

34. An enclosure as recited in claim 32, wherein each upper and base connector includes:

a base component having a platform with a first upstanding truss on an edge thereof; and an upper component having a flange for engaging the base component with a second upstanding truss thereon, wherein the first and second upstanding trusses define a channel for receiving a portion of the respective upstanding support, such that when the enclosure is assembled, the upstanding supports are fixed to the respective connectors.

35. An enclosure as recited in claim 32, wherein each of the transverse upper and base supports includes a pivotable coupling for pivotally moving opposing sides of the supports relative to each other.

36. An enclosure as recited in claim 32, further comprising means attached to the frame for retaining the enclosure in a substantially minimized condition.

37. An enclosure as recited in claim 36, wherein said means is one of a strap and a transport bag.

38. An enclosure for restraining a patient to an area about a bed, wherein the bed is adapted to support the patient, comprising:

a removable and collapsible frame adapted to surround the bed and to be positioned on a surface supporting the bed, including:

first means for supporting, and for defining a bed-shaped area for receiving thereunder the bed;

second means for supporting a first head portion of the first means above the bed; and third means for supporting a second portion of the first means above the bed, wherein at least one of the first means, the second means and the third means is movable relative to at least one of the other for folding the collapsible frame for transport or storage; and fourth means connectable to the first means for defining an enclosed patient area about the bed such that the patient is allowed to move freely within the area;

fifth means for selectively forming an opening through the fourth means and allowing access to the patient area therethrough; and sixth means for permitting visual monitoring of the enclosed patient area from, outside of the fourth means.

39. An enclosure as recited in claim 38, further comprising seventh means for pivotally connecting the first means to the second means and to the third means, and for fixing the first means, the second means and the third means relative to each other.

40. An enclosure as recited in claim 39, wherein the seventh means is a pivotal coupling.

41. An enclosure as recited in claim 38, wherein the first means is an upper laterally extending support.

42. An enclosure as recited in claim 38, wherein the second means is an upstanding support.

43. An enclosure as recited in claim 38, wherein the third means as an upstanding support.

44. An enclosure as recited in claim 38, wherein the fourth means as a canopy.

45. An enclosure as recited in claim 38, wherein the fifth means is an access portion movable between a closed position and an open position defining an opening through the fourth means for allowing access to the patient area.

46. An enclosure as recited in claim 38, wherein the sixth means is a see-through portion of the fourth means that permits visual monitoring therethrough of the patient area.

47. An enclosure as recited in claim 46, wherein the see-through portion is defined by a dark-colored mesh.

48. An enclosure as recited in claim 47, wherein the color of the mesh is selected from the group including black, blue and brown.

49. A method for restraining a patient to an area about a bed adapted to support the patient, the method comprising the steps of:

providing a removable and collapsible frame including an upper support and a plurality of upstanding supports coupled to the upper support, wherein at least one of the upper supports and upstanding supports is movable relative to at least one of the other supports for folding the frame into a collapsed condition and unfolding the frame into an open condition;

positioning the collapsible frame in an open condition on a surface supporting the bed;

surrounding the bed with a canopy supported on the frame and defining an area within the canopy and about the bed within which the patient is allowed to move;

allowing access to the patient through a portion of the canopy that is movable between an open and a closed position; and allowing visual monitoring of the patient from outside of the canopy through a see-through portion of the canopy.

50. A method as recited in claim 49, further comprising the step of collapsing the frame by pivoting at least a portion of the upper support inwardly toward at least one of the upstanding supports.

51. A method as recited in claim 49, wherein the frame includes a lower support coupled to the upstanding supports and opposing the upper support, and further comprising the step of collapsing the frame by pivoting at least a portion of the upper support downwardly toward the lower support and at least a portion of the lower support upwardly toward the upper support.

* * * * *